United States Patent [19]

De Filippo et al.

[11] Patent Number: 4,725,340

[45] Date of Patent: Feb. 16, 1988

[54] TARTRATE-CONTAINING ALLOY BATH FOR ELECTROPLATING BRASS ON STEEL WIRES AND PROCEDURE FOR EMPLOYING THE SAME

[75] Inventors: Domenico De Filippo, Sinnai; Antonella Rossi, Cagliari; Leo Ambrosio, Quartu Sant'Elena; Francesco Simbula, Giulianova, all of Italy

[73] Assignee: Consiglio Nazionale Delle Ricerche, Rome, Italy

[21] Appl. No.: 890,435

[22] Filed: Jul. 29, 1986

[51] Int. Cl.[4] ..... C25D 3/56; C25D 3/58; C25D 5/04; C25D 7/06

[52] U.S. Cl. ..... 204/28; 204/27; 204/44

[58] Field of Search ..... 204/44, 27, 28

[56] References Cited

FOREIGN PATENT DOCUMENTS

| | | | |
|---|---|---|---|
| 26815 | 12/1974 | Japan | 204/44 |
| 2063725 | 6/1981 | United Kingdom | 204/28 |
| 254989 | 4/1970 | U.S.S.R. | 204/44 |

OTHER PUBLICATIONS

Abner Brenner, "Electrodeposition of Alloys", vol. I, pp. 462–464, (1963).

*Journal of Applied Electrochemistry*, vol. 8, 1978, pp. 33–39, "Effect of Some Plating Variables on the Electrodeposition of Cu-Zn Alloys from Alkaline Tartrate Baths" by Abd El Rehim et al.

*Galvanotechnik*, vol. 71, No. 7, Jul. 1980; *Zascita Metallow*, vol. XVI, 1980, pp. 185–187.

*Chemical Abstracts*, vol. 72, No. 24, Jun. 15, 1970, pp. 512.

*Chemical Abstracts*, vol. 77, No. 2, Jul. 10, 1972, p. 572, "Effect of Some Additives on the Cathodic Process During Copper-Zinc Alloy Electrodeposition from Tripolyphosphate Electrolytes".

*Chemical Abstracts, vol. 79, No. 22, Dec. 3, 1973, "Electrodeposition of Tombac Copper-Zinc Alloy from Tartaric Acid Bath".*

*Chemical Abstracts*, vol. 102, No. 2, Jan. 14, 1985, pp. 484, "Electrodeposition of an Adherent Layer of Brass on Steel Parts Prior to Coating with Rubber".

*Chemical Abstracts*, vol. 97, No. 22, Nov. 29, 1982, "Electrodeposition of a Copper-Zinc Alloy From a Tartrate Electrolyte".

*Primary Examiner*—G. L. Kaplan

*Attorney, Agent, or Firm*—Pollock, Vande Sande & Priddy

[57] ABSTRACT

Tartrate-containing alloy bath for electroplating brass on steel wires which are particularly designed for use in the production of radial tires, and the employment of said alloy bath in a continuous manufacturing process in which brass is plated directly on said steel wires in the desired amounts and compositions.

18 Claims, 13 Drawing Figures

Fe
Cu
Zn
PEAK-TO-PEAK
10
20
30
40 min.
ETCHING-TIME

TARTRATE-CONTAINING ALLOY BATH FOR ELECTROPLATING BRASS ON STEEL WIRES AND PROCEDURE FOR EMPLOYING THE SAME

The present invention relates to a tartrate-containing alloy bath for electroplating brass on steel wires as well as to the procedure for employing said bath. More particularly, the present invention relates to the definition of parameters concerning the composition and the operative conditions of the bath, which is specifically designed for electroplating brass on steel in a continuous way and at high current densities. The resulting brass-coated wires are widely employed in the production of radial tires and pipes for high pressure service.

With reference to the fundamental application of the bath according to the present invention, it is to be kept in mind that brass-coated steel wires, usually having diameters between 0.60 and 2.00 mm, must satisfy a number of requirements, and more particularly the following ones:

brass coatings must be substantially of the $\alpha$ (cubic) structure, which is necessary to obtain a satisfying behaviour to drawing as well as a satisfying adhesion to the steel surface; the surface further, composition of the coating must be such as to warrant an optimal adhesion to rubber as a function of the rubber batch employed;

homogenity of the coating composition from the steel/brass interface to the brass/rubber interface is required;

a coating thickness between 0.1 and 3.5 $\mu$m is required, which thickness warrants the possibility of drawing the wire and, after drawing and stranding, assures a continuous coating of the steel surface so as to avoid the presence on that surface of unprotected areas and therefore corrosion risks.

As is well known, brass-coated wires of the type mentioned above are obtained at the present time through a manufacturing procedure comprising the following operations as successive steps:

(a) heat treatment at about 1000° C. of a steel rod (of a suitable composition—C about 0.7%; Mn about 0.6%—and of perlitic structure) and drawing of said rod to the diameter required;

(b) heat treatment within a furnace at 1000° C. of the steel wire (which is kept moving at a speed between 10 and 50 m/min), of the same in a molten lead bath at 500°-600° C. and electrochemically pickling said wire in 2M $H_2SO_4$ at 35° C.;

(c) electroplating the following on the polished wire: (1) copper from $H_2SO_4$ acid bath; (2) copper from pyrophosphate alkaline bath; (3) zinc from $H_2SO_4$ acid bath;

(d) diffusion of copper and zinc layers by heating to about 700° C. through a heating step and a soaking and tempering step to form the alloy;

(e) drying the wire so coated and freeing the same from the surface oxides by acid treatment.

However, it is to be observed that such production process is not free from drawbacks, and more particularly the following ones:

complexity of the galvanic operation plant for realizing three separate electroplating processes from galvanic baths which are alternately acid/alkaline/acid, which imposes the need for intermediate washing (hot washing and cold washing) to avoid pollution, due to entrainment, of the successive electrolytic baths; high cost and difficulties of operation of three separate galvanic baths, with particular reference to the alkaline copper plating bath whose sensitivity to the polluting agents (such as chloride, sulfate, ferric, plumbous ions, etc.) is very high;

zinc losses through evaporation and oxidation during the diffusion process;

interruptions in the continuity of the coating due to sparking originating from unsteady contacts during said process;

compositional inhomogeneities of the coating through its thickness.

The last mentioned drawback can be evidenced through AES spectrometry (Auger electrons spectrometry), as can be seen in FIG. 1 of the enclosed drawings, which illustrates results of an AES analysis of a steel wire coated with brass through diffusion by Joule effect. The so-called etching-time is reported as the abscissas, which corresponds to the depth from the surface, while the percentage concentration of the two alloy elements is reported as the ordinates.

It is to be observed that, employing the traditional procedure disclosed above, the homogeneity of the coating composition depends on the duration and temperature of the diffusion step, as well as on the average size of the copper microcrystals forming the stationary phase, so that such homogeneity cannot be easily warranted, mainly because the copper crystal growth during electroplating of the metal depends on such a large amount of parameters (pH, stirring, temperature and composition of the bath, current density etc.) as to be very hard to control.

The need for a simplification of the traditional electroplating process, mainly as regards the employment of a number of galvanic baths, has been felt for a long time, and quite precise information is available as regards the possibility of simultaneously electrodepositing metals having very different discharge potentials such as copper and zinc, for instance, through the use of complexing agents, which are capable of lowering such differences.

With reference to that problem, the possibility has been known form some time of employing such agents in the so-called "alloy baths", such as for instance cyanide baths, baths containing variously polymerized phosphoric ions, or ethylenediamine or polyethylenpolyamine of various natures, for electroplating brass directly with no successive diffusion process, thus eliminating or reducing the drawbacks mentioned above.

However, such baths were shown to be unsatisfactory both owing to the toxicity of the reactants and to the difficulties involved in using the same for a continous, high production rate operation, because said baths do not result in stability of the coating composition with time (reproducibility) and the obtainment of the desired Cu/Zn ratio in the coating through the simple control of the value of that ratio in the bath.

Thus, it is clearly evident that the employment of one only alloy bath such as that proposed in the present invention is very important, said alloy bath allowing the electroplating of brass to be performed directly at the desired amounts and compositions in a continous operation process.

It is interesting to note that the prior art studies as regards the complexing agents put into evidence, among the other things, the use of tartrate (S. S. Abd El Rehim and M. E. El Ayashy, Journal of Applied Electrochemistry, 8, (1978) 33-39; S. S. Abd El Rehim, ibidem, 8 (1978) 569-572), which, in an alkaline environment, allows the obtainment of copper and zinc discharge potentials so close to one aother that the electroplating of such metals occurs substantially simultaneously.

Indeed, it has been observed that the predominant ionic species in the solution, in the presence of tartrate ion ($C_4H_4O_6^{2-}$) and at alkaline pH's, are those which originate from the complexing equilibriums balanced by the following constants:

| | | |
|---|---|---|
| for copper pH ≧ 10 | $Cu(OH)_2C_4H_4O_6^{2-}$ | $Ki = 7.3 \times 10^{-20}$ |
| for zinc pH 5.5 ÷ 11 | $Zn(OH)C_4H_4O_6^{-}$ | $Ki = 2.4 \times 10^{-8}$ |
| 11 | $Zn(OH)_3^{-}$ | $Ki = 3 \times 10^{-16}$ |
| 14 | $Zn(OH)_4^{2-}$ | $Ki = 2 \times 10^{-13}$ |

However, such information relates to laboratory experiments in which no suggestion can be seen of an operative procedure suitable for industrial application; in particular, no concrete teaching exists as regards the actual definition of a continuous operating process, and no indication exists that the notion has been conceived that it is necessary to set forth and control the value of the Cu/Zn ratio in the solution so as to warrant the obtainment of a given composition of the plated coating. Finally, no transportation seems to have been performed of the values obtained in the laboratory (for instance, at current density of about 0.2 A/dm$^2$) to the situation actually occurring in an industrial plant (current densities up to 40 A/dm$^2$).

In order to realize a continous process on an industrial scale for electroplating brass of the desired composition on steel wires, the present invention suggests a tartrate-containing alloy bath containing:

tartrate ion: 0.8–1.5M
copper ion: 0.3–0.6M
zinc ion: 0.1–0.3M
alkaline hydroxide: 1.5–3M with a Cu/Zn ratio of 1.5–3.5 and a density of 1.10–1.3 g/cm$^3$ at 20° C.

According to a preferred embodiment of the present invention, such bath also contains:

ammonium chloride: 0.05–0.1M
ammonium nitrate: 0.05–0.1M

Preferably said alkaline hydroxide is caustic soda (NaOH) or potash ((KOH).

The application of the bath is to be performed according to the present invention respecting the following conditions:

Temperature: 25°–50° C.
Current density: 5–40 A/dm$^2$

For the preparation of the bath (in order to avoid the presence of foreign ions) basic copper carbonate and basic zinc carbonate are employed, with removal of carbon dioxide by reaction with tartaric acid. When the shifting reaction has been completed, the necessary amount of potassium sodium tartrate (Seignette salt) is added to bring the total concentration of the tartrate ion to the required value. Next, sodium hydroxide as well as the other components are added.

The definition of the above-mentioned critical parameters of the bath according to the present invention has been obtained through a set of experimental tests aiming at checking the possibility of using a tartrate bath on an industrial scale and at studying the behaviour of the bath as a function of such parameters.

Said tests have been carried out with a rotating brass electrode (satured calomel electrode (SCE) as a reference electrode; counterelectrode: Pt) by means of potentiodynamic polarizaion measurements, and they gave the results reported in FIGS. 2–6, in which the current densities (A/dm$^2$) are reported as the ordinates, and the discharge potential, expressed as Volts and referred to the saturated calomel electrode (SCE), is reported as the abscissas.

BRIEF DESCRIPTION OF THE FIGURES

FIG. 2 of the enclosed drawings illustrates the electroplating curves of copper, zinc and of the alloy, from tartrate baths containing one only metal ion or both metal ions. As it can be clearly observed, the curve relating to the discharge of the alloy is intermediate between the discharge curves of the two single metals, so that the effective electroplating of brass from a tartrate galvanic bath is confirmed.

FIG. 3 shows that, for the same ionic ratio, the discharge potential is shifted towards less negative values on increasing the concentration of the alkaline compound (NaOH).

FIG. 4 puts into evidence that, at the same value of the Cu/Zn ratio and at constant alkalinity, the discharge potential is shifted, on the contrary, towards more negative values on increasing the concentration of the tartrate ion. It can be observed that the addition of an alkaline compound such as caustic soda, which is indispensable for the establishment of the alkaline conditions necessary to keep the complexing equilibriums mentioned above, performs the function of compensating for the shift towards more negative dischage potentials which results from the addition of the tartrate ion.

FIG. 5 puts into evidence that the addition to the bath of increasing amounts of $NH_4Cl$, which is necessary to give the plated coating a brilliant yellow color, occurs with no significative changes in the discharge potential, whereas in the case of addition of $KNO_3$ as a depolarizing agent (FIG. 6) the influence of the addition is not negligible.

The analysis of the coatings obtained in all said experimental tests showed the possibility of electroplating brass essentially of the $\alpha$ phase and with an excellent adhesion to steel.

The possibility of industrial application of the bath according to the present invention has been confirmed, among the other things, by experimental observations as regards the possibility of obtaining in the anodic process a "simultaneous" type dissolution employing brass anodes of the desired composition.

Aiming at that object the selective coefficient was determined, as defined by the relationship:

$$Z = \frac{(\text{ppm Zn/ppm Cu})\ \text{solution}}{(C_{Zn}/C_{Cu})\ \text{electrode}}$$

as a function of time, working with a tartrate alkaline solution at 25° C. and at current densities as follows: anodic current density, 0.45 A/dm$^2$; cathodic current density, 15 A/dm$^2$.

Results obtained are reported in the following Table 1 and they show that, in a bath which at 0 time is free from $Cu^{++}$ and $Zn^{++}$ ions, the dissolution is at first of a preferential type but after about 1 hour it becomes of a simultaneous type.

TABLE 1

Values of the selectivity coefficient Z at 25° C. with brass anodes (Cu 67.5%, Zn 32.5%) at various concentrations of the nitrate ion.

| | Z VALUES | | |
|---|---|---|---|
| time (min) | 3 g/l $NO_3$ | 6 g/l $NO_3$ | 9 g/l $NO_3$ |
| 0 | 3.56 | 5.4 | 2.71 |
| 4 | 1.56 | 1.87 | 1.51 |
| 8 | 1.40 | 1.40 | 1.30 |
| 10 | 1.27 | 1.29 | 1.30 |
| 20 | 1.24 | 1.31 | 1.32 |
| 30 | 1.16 | 1.17 | 1.17 |
| 40 | 1.06 | 1.14 | 1.25 |
| 50 | 1.09 | 1.10 | 1.06 |
| 60 | 1.06 | 1.10 | 1.02 |
| 75 | 1.03 | 1.11 | 1.05 |
| 90 | 1.03 | 1.03 | 1.01 |
| 120 | 0.99 | 1.00 | 1.01 |
| 180 | 0.96 | 1.00 | 0.97 |

Analyses were carried out by atomic absorption spectrophotometry (AAS).

Figure 1:
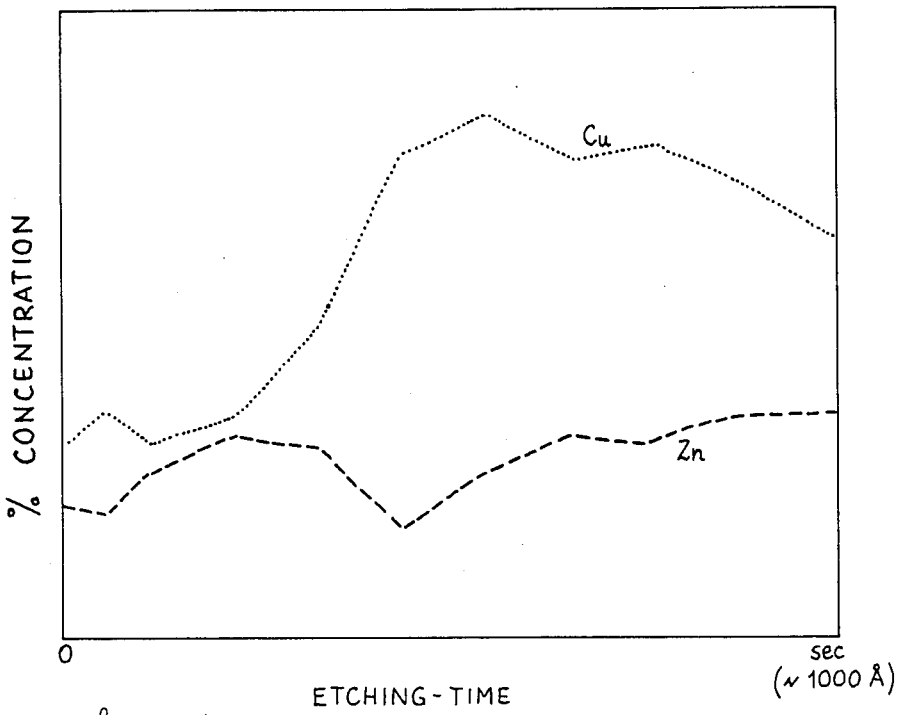
FIG. 1 is a graph showing the relationship between concentrations of copper and zinc and plating depth for brass which is coated onto steel wire through diffusion.
Figure 2:
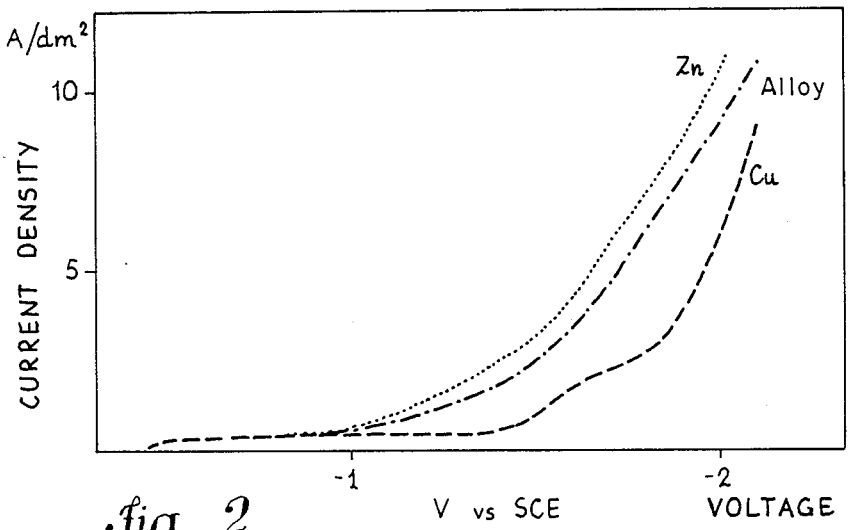
FIG. 2 is a graph of electroplating curves for copper, zinc and the alloy produced by the bath of this invention.
Figure 3:
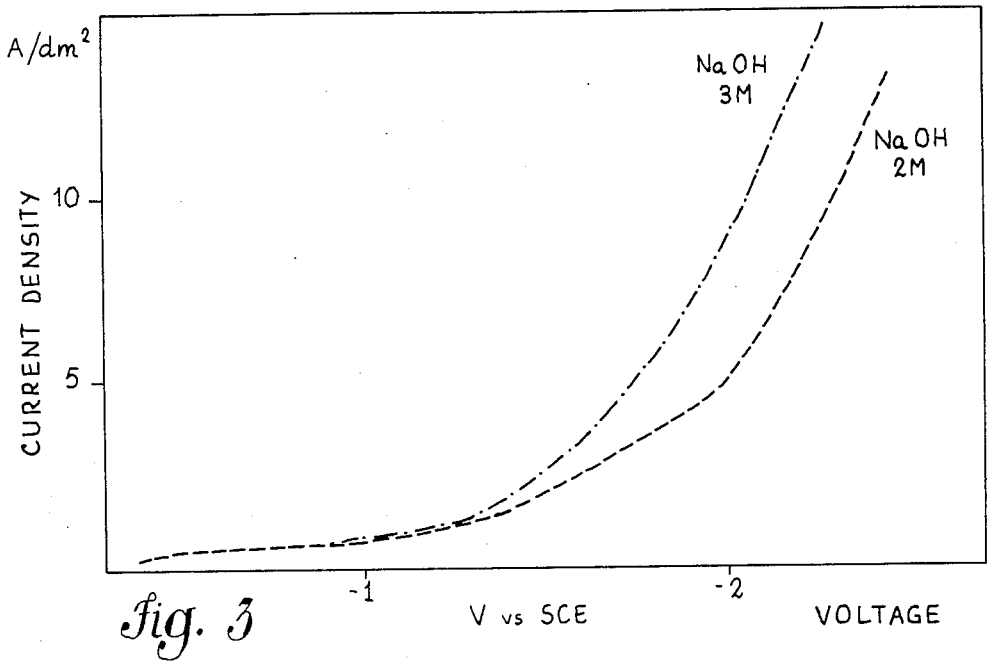
FIG. 3 is a graph showing the effect on electroplating curves of the concentration of NaOH in the bath.
Figure 4:
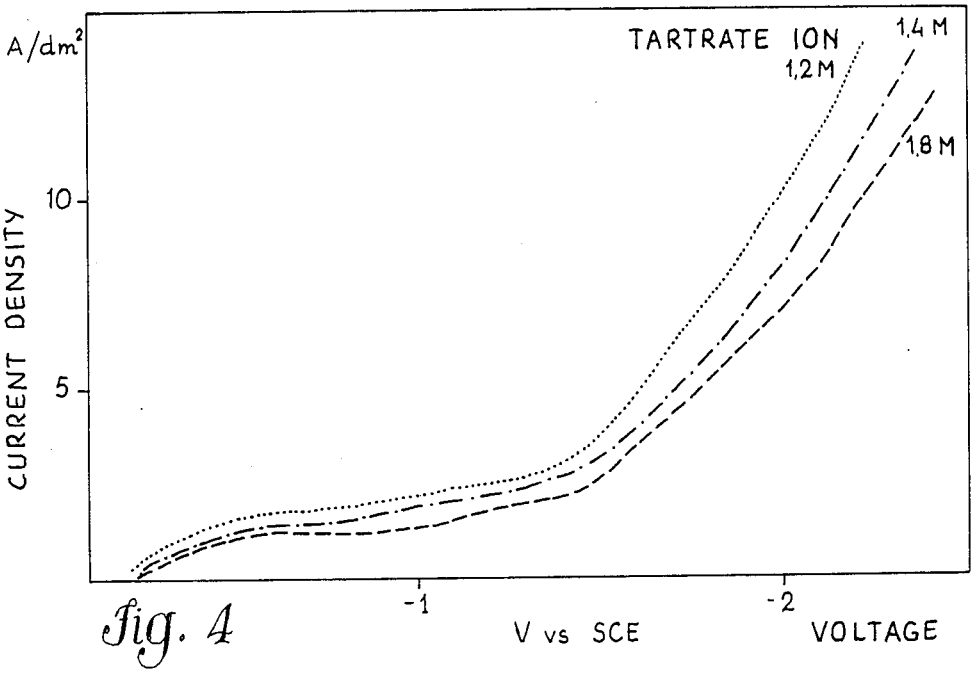
FIG. 4 is a graph showing the effect on electroplating curves of the concentration of tartrate in the bath.
Figure 5:
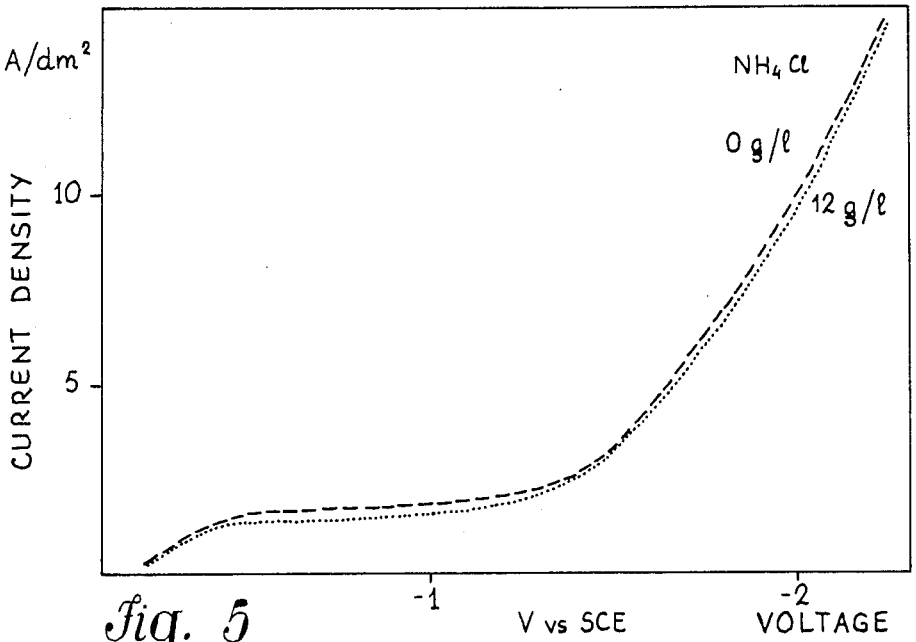
FIG. 5 is a graph showing the effect of adding $NH_4Cl$ to the bath.
Figure 6:
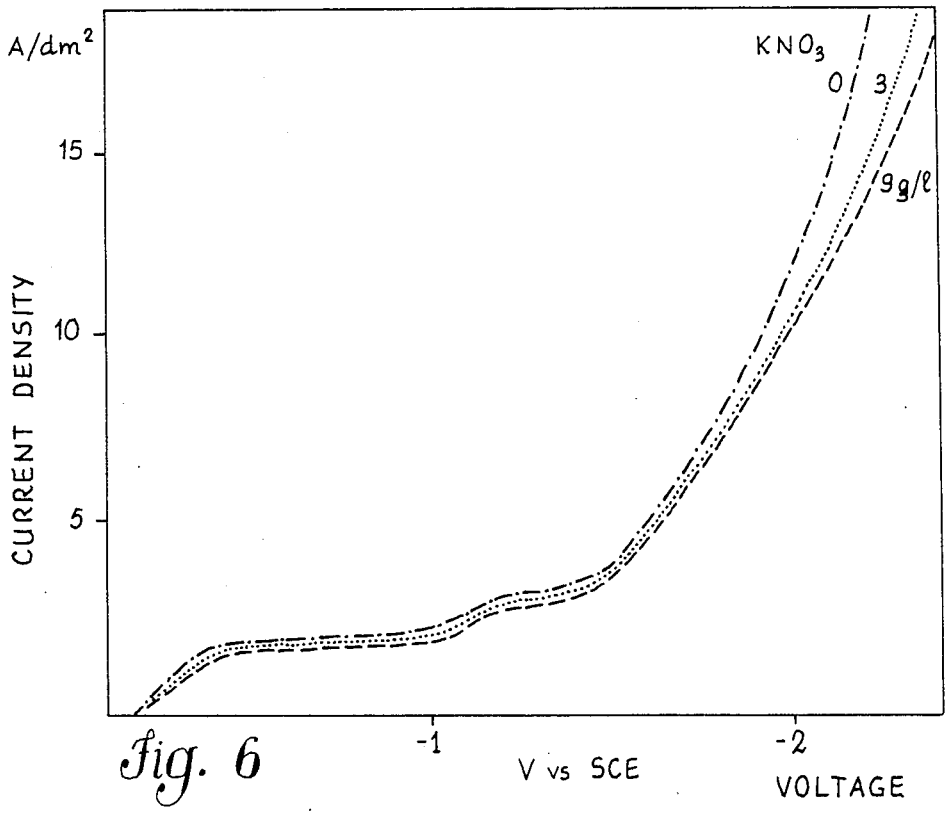
FIG. 6 is a graph showing the effect of adding $KNO_3$ to the bath.
Figure 7:
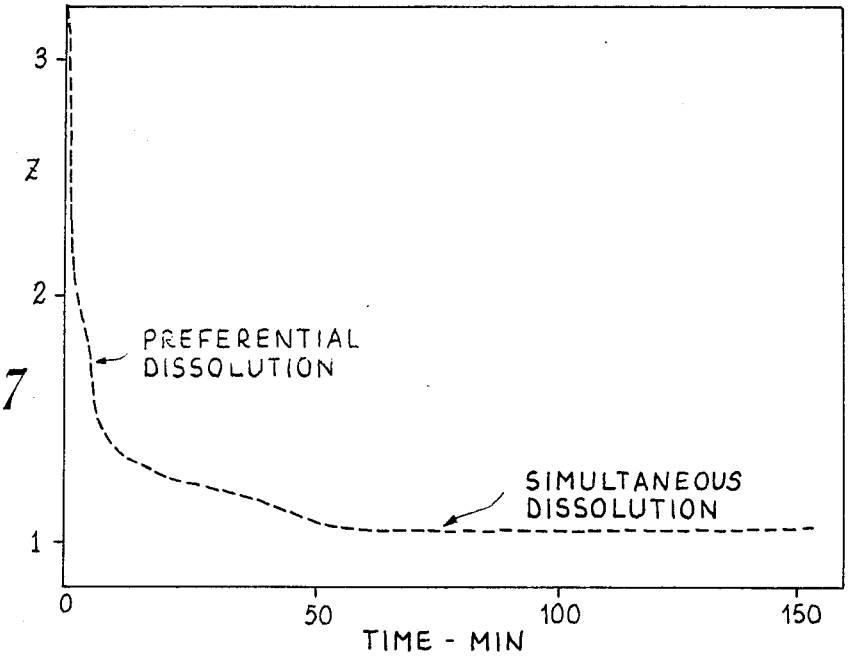
FIG. 7 is a graph showing the dissolution selection effect when dissolving a brass anode in an alkaline tartrate solution.

FIG. 7 shows the behaviour of the selectivity coefficient Z (as the ordinates) as a function of time, for the dissolution of brass anodes (68/32) in a tartrate alkaline solution (the curve being averaged over 65 determined values—$KNO_3$ from 3 to 9 g/l—25° C.—cathodic c.d. 15 A/dm$^2$, anodic c.d. 0.45 A/dm$^2$). The concentration of the depolarizing agent (the $NO_3^-$ ion), which allows the copper to be dissolved at the anode, is not a determining factor at least in the range from 3 to 9 g/l.

Another factor which according to the present invention was shown to be of fundamental importance for setting forth the effective industrial potentiality of the process is the dependence of the coating composition on the temperature as well as on the Cu/Zn ratio in the solution.

Figure 8:
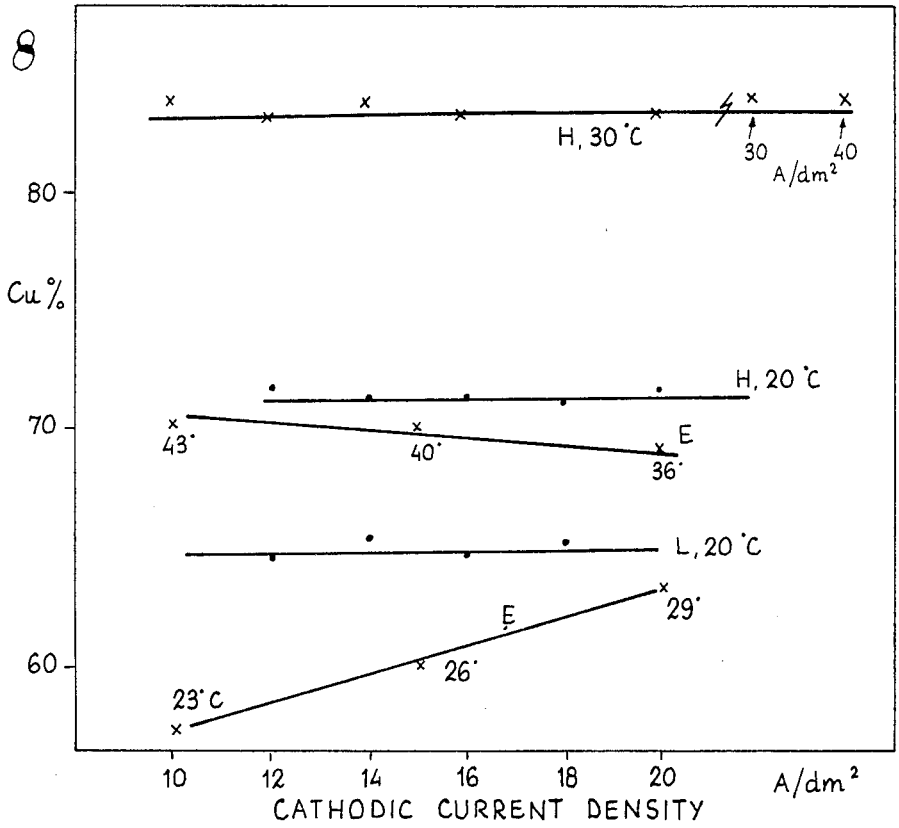
FIG. 8 is a graph showing the effect on the copper concentration in coatings of constant or varying bath temperatures.

With reference to such result, FIG. 8, in which the copper percentage concentration in the coating (Cu %) is reported as the ordinates and the cathodic current density (A/dm$^2$) is reported as the abscissas, shows the curves relating to coatings obtained from various galvanic baths at different values of current density, operating at a given temperature value (baths H,L) or at different temperature values (bath E). Baths H, E and L are selected among those which are typical of the present invention and which are reported in the following in Table 2.

Such curves show that the composition of the coating is not fundamentally affected by the values of the current density but, for a certain value of the Cu/Zn ratio, it depends quite remarkably on temperature.

Figure 9:
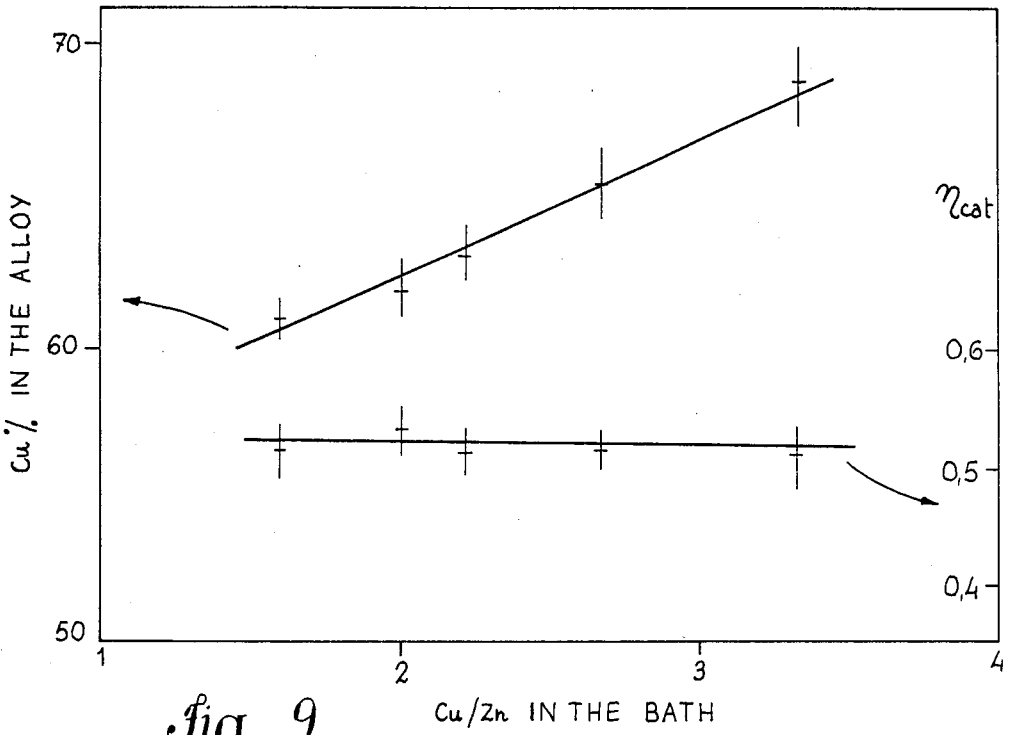
FIG. 9 is a graph showing the effect of changing ratios of Cu/Zn in the bath to the copper concentration in the alloy and the cathodic current yield.

FIG. 9 shows, as the ordinates, the composition of the coating (on the left) given as the copper percentage concentration in the alloy, and (on the right) the cathodic current yield ($\eta_{cat}$) at various Cu/Zn ratios at 30° C. and at 16 A/dm$^2$, as functions of the Cu/Zn ratio in the bath.

The cathodic current yield is always quite lower than 1; operating at a current density of 16 A/dm$^2$ and at 30° C., the value of such parameter is close to 0.5. However, such parameter is to be previously determined for each composition as well as for each set of operative conditions.

Figure 10:
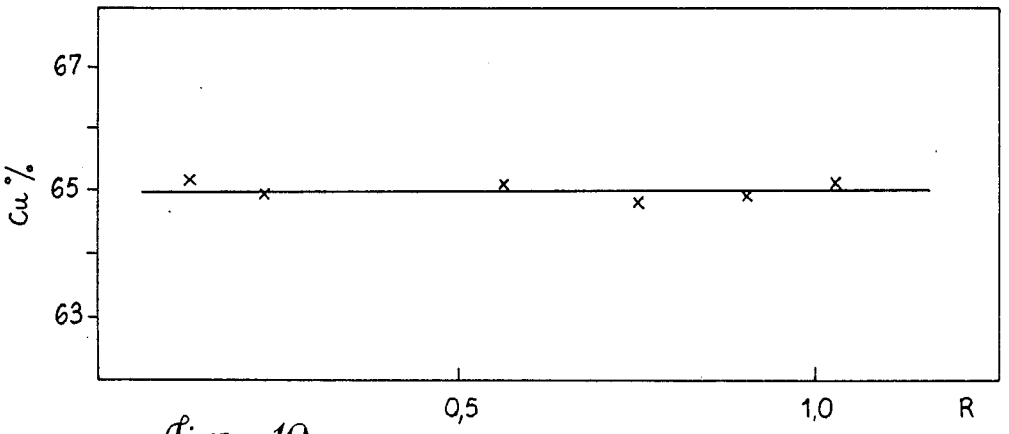
FIG. 10 is a graph showing the concentration of copper in the coating as a function of the ratio between the amount of alloy coated and the initial amount of copper and zinc in the bath.

Finally, it was established that the coating so obtained has a composition which is stable during the time of employment of the bath, as is clearly shown in FIG. 10, wherein the copper percentage concentration in the coating is reported as the ordinates and the ratio between the amount of the alloy coated and the initial amount of copper and zinc in the bath (R) is reported as the abscissas. The behaviour of the coating composition on increasing the total amount of the current passed through the galvanic cell is represented by a horizontal straight line.

The bath according to the present invention can be operated quite easily as it substantially requires just the continuous control of the following parameters:

Cu/Zn ratio in the solution
anode composition
nitrates and ammonia
free and total alkalinity
operating temperature
galvanic bath density.

Thus it is necessary to employ thermoregulated plants and an analytical service station equipped with atomic absorption spectrophotometer and with potentiometers having electrodes specific for the nitrate ions and for ammonia. Such analyses can be performed directly in the galvanic bath at its own service concentration introducing any suitable corrections in a continuous way by means of metering pumps, so that all parameters pointed out above are kept constant with time.

Within the class of tartrate-containing alloy baths for electroplating brass on steel wires, the galvanic baths which were shown to be particularly preferable according to the present invention are those having the compositions shown in the following Table 2.

TABLE 2

| | Compositions of some typical baths | | | | | | | | | |
|---|---|---|---|---|---|---|---|---|---|---|
| | Abbreviations of the bath | | | | | | | | | |
| | H | | E | | L | | M | | N | |
| Reactant | g/l | M | g/l | M | g/l | M | g/l | M | g/l | M |
| tartaric acid | 90 | | 111 | | 83 | | 90 | | 97.5 | |
| Seignette salt | 112 | | 203 | | 127 | | 112 | | 99 | |
| total tartrate ion | | 1 | | 1.46 | | 1 | | 1 | | 1 |
| bas.$CuCO_3$ (titr. 56% Cu) | 45.4 | | 55.6 | | 45.4 | | 45.4 | | 45.4 | |
| corresp. to Cu ion | | 0.4 | | 0.49 | | 0.4 | | 0.4 | | 0.4 |
| bas.$ZnCO_3$ (titr. 57.4% Zn) | 22.6 | | 28 | | 17 | | 22.6 | | 28.3 | |
| corresp. to Zn ion | | 0.2 | | 0.25 | | 0.15 | | 0.2 | | 0.25 |
| NaOH | 80 | 2 | 120 | 3 | 100 | 2.5 | 100 | 2.5 | 120 | 3 |
| $NH_4Cl$ | 2.7 | 0.05 | — | — | 2.7 | 0.05 | 2.7 | 0.05 | 2.7 | 0.05 |
| $NH_4NO_3$ | 4.0 | 0.05 | — | — | 4.0 | 0.05 | 4.0 | 0.05 | 4.0 | 0.05 |
| Cu/Zn ratio | 2 | | 1.96 | | 2.67 | | 2 | | 1.6 | |
| density (g/cm$^3$) | 1.175 | | 1.259 | | 1.212 | | 1.204 | | 1.222 | |

As already pointed out above, the tartrate-containing alloy baths according to the present invention can be specifically employed in the continuous production of steel wires coated with brass, which are designed for the production of radial tires. Such baths allow said brass coating operation to be carried out by means of one only electroplating process, performed on steel wires pre-treated according to the commonly employed techniques, the electroplating operation being followed by water washing at room temperature.

Figure 11:
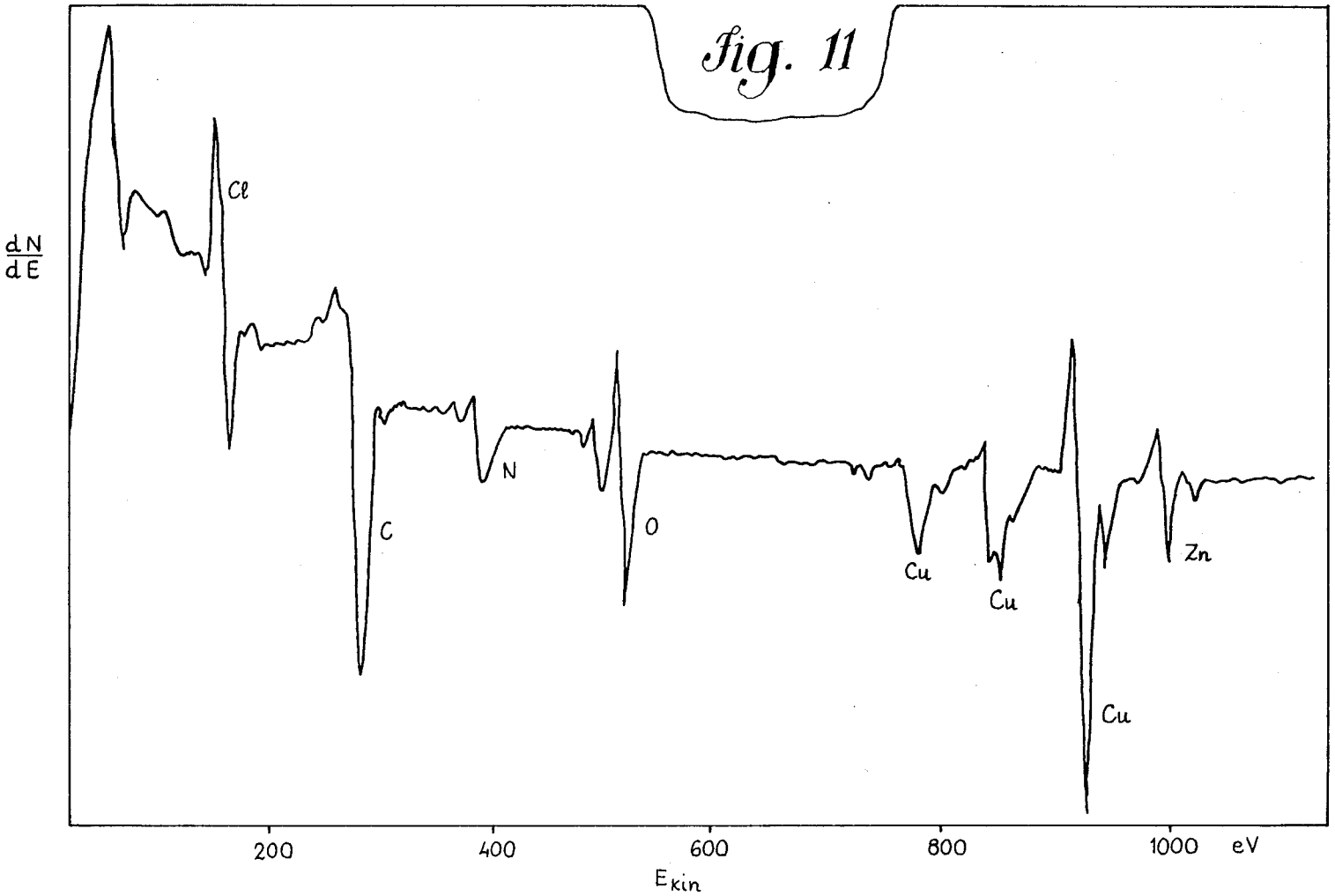
FIG. 11 is a graph showing the AES spectrum of a brass coating.

The coating shows a constant composition throughout its full thickness as is proved by the AES spectrometry. With reference to that, FIG. 11 shows an AES spectrum of the surface of a steel wire of 1.4 mm size, coated with brass of 2 μm thickness and of composition 64.2% Cu and 35.8% Zn. Such coating was obtained at 30° C. with a current density of 16 A/dm$^2$. The derivative (dN/dE) of the number of electrons with respect to the kinetic energy of the same is reported as the ordinates, and the values of the kinetic energy $E_{kin}$ are reported as the abscissas expressed as eV. The complete composition of the coating at its surface can be read off such diagram.

Figure 12:
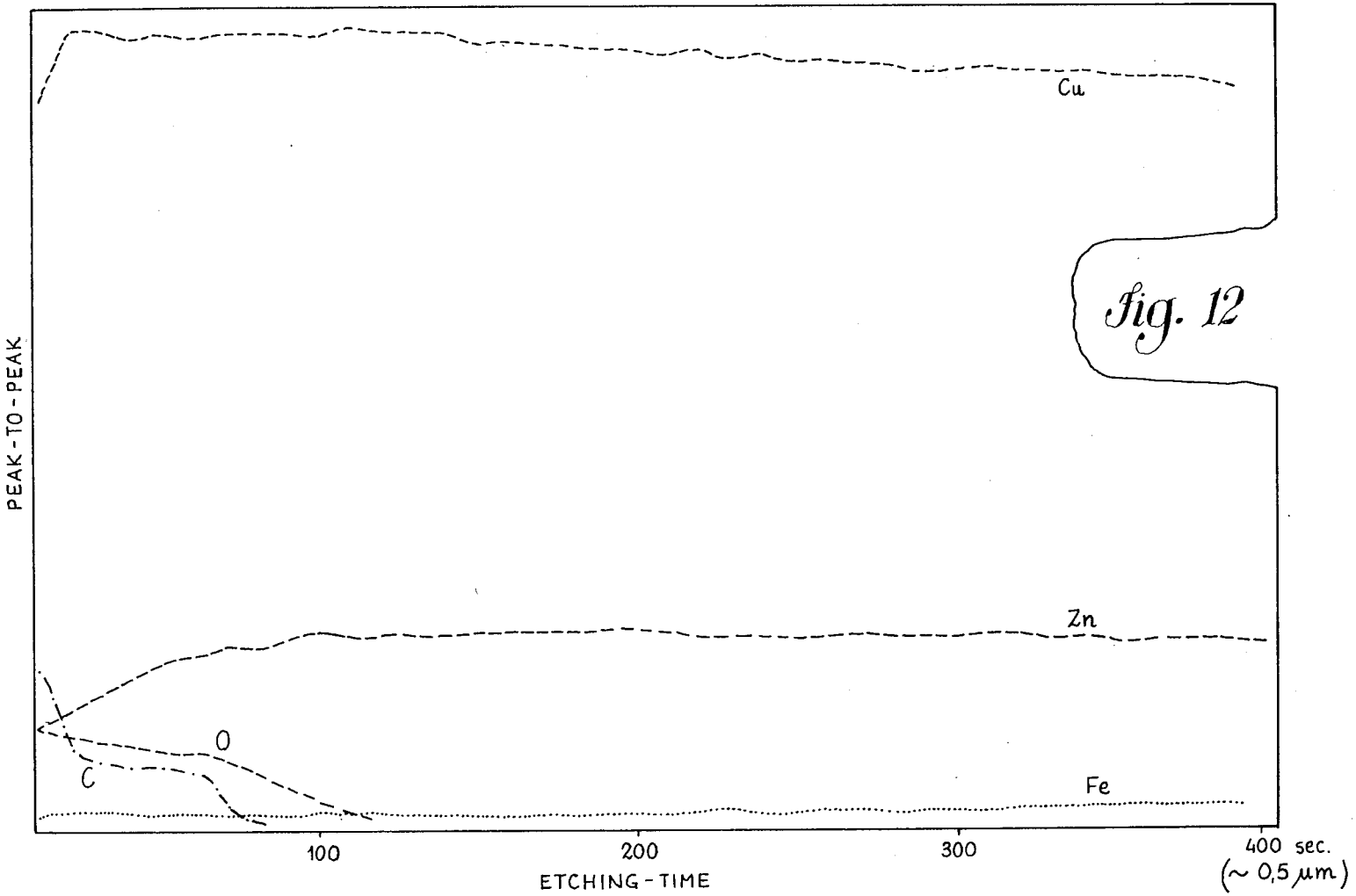
FIG. 12 is a graph showing the values of concentration correlated with etching times.

FIG. 12, in which the ordinates show the values of a "peak-to-peak" parameter proportional to the concentration and the abscissas show the so-called etching time in seconds, illustrates the results of an AES analysis of the same wire, from which the stability of the alloy composition throughout its full thickness can be clearly appreciated. The initial variations in the composition should not be taken into account as they depend on the concentration drop of C and O, which are present at the surface as polluting agents.

The coating shows a very high degree of continuity as well as a very high corrosion resistance. The corrosion rate was shown to be of 0.073 mm/year at 20° C. in a 0.1M HCl solution added with 1 g/l NaCl and 0.3 g/l $CaCl_2$.

Under the same conditions the average corrosion rate of the steel wire is of 0.63+0.1 mm/year.

Adhesion to rubber was shown satisfying and substantially corresponding to the common standard.

The present invention will be disclosed in the following by an example referring to a preferred procedure for the production of a steel wire coated with brass by means of a tartrate-containing alloy bath.

EXAMPLE

The brass coating experiments were carried out on a small-scale pilot plant (scale about 1:15) with speeds between 1 and 5 m/minute. Such pilot plant consists of a series of galvanic bath tanks (PVC, titanium bolts and nuts and titanium contacts) with weirs and of suitable lenghts, each bath tank being fed independently by its own thermostat (±0.5° C.); the plant also comprises an unwinding device and a winding device, both of them being operated with controlled linear velocity (±1 cm/minute). The electrical circuits are fed by AMEL galvanometer/potentiometer controllers (±1 mA).

A typical example of the procedure followed in the experimental tests is as follows:

steel wire samples (perlitic structure, 0.7% C, 0.6% Mn, 1.4 mm diameter) coming from previous mechanical and heat treatments, were coated with brass in the pilot plant mentioned above according to the following operations:

washing with water at room temperature
brass coating
washing with water at room temperature
drying with compressed air Employing the composition bath L and Cu/Zn anodes (67/33% by weight) under the following operative conditions:

temperature: 35°±0.5° C.
current density: 20 A/dm$^2$
wire speed: 1±0.01 m/minute the following coating was obtained:

amount: 5.09 g/kg
composition: Cu, 65.6%; Zn, 34.5%
adhesion: 80.5±15 kg
standard: 80.9±12 kg (procedure for the ASTM adhesion test: STANDARD rubber batch, 155° C., 35 minutes ½ inch immersion, ½ inch pull hole).

Figure 13:
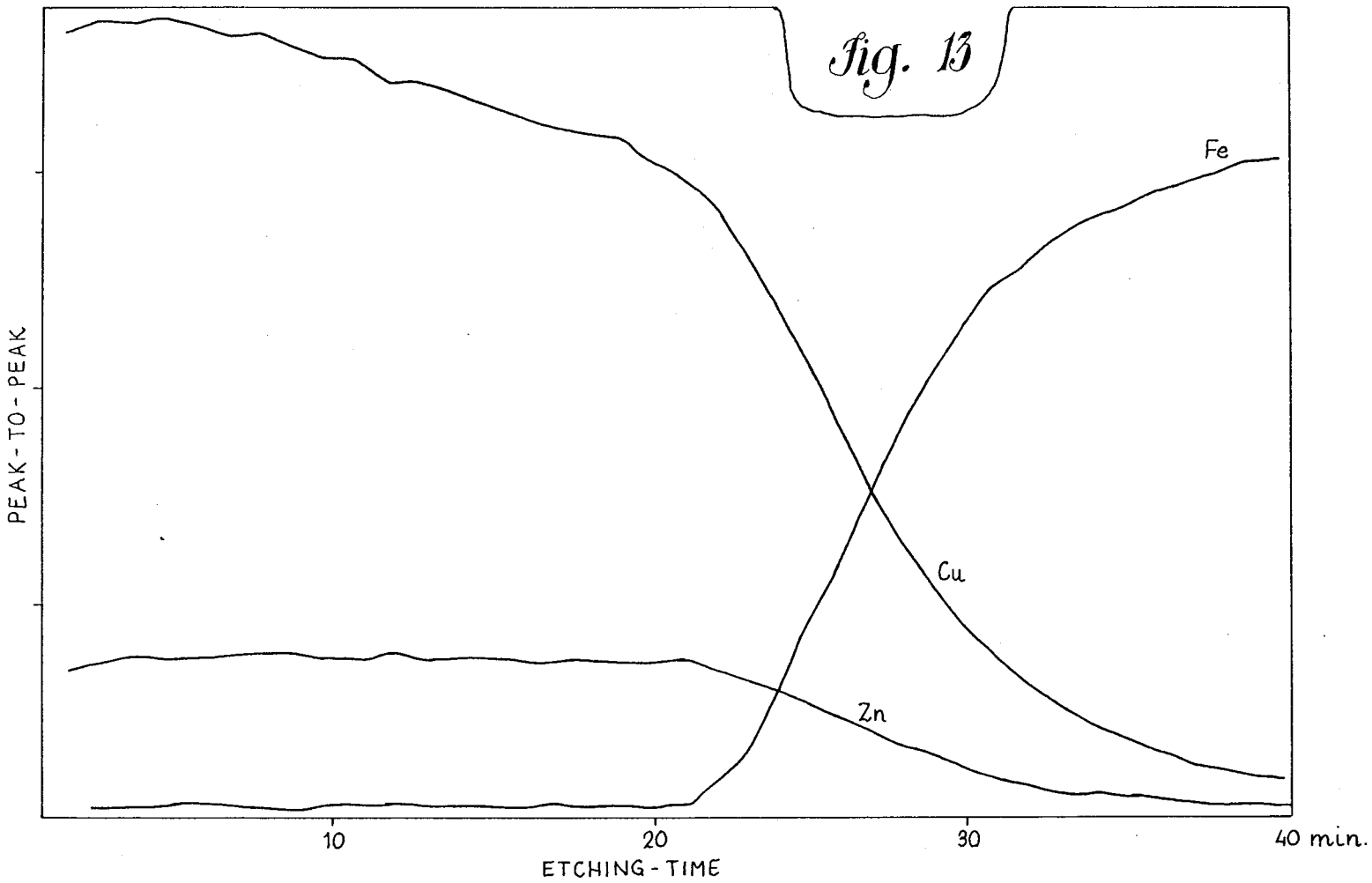
FIG. 13 is a graph showing the results of an analysis of coating obtained correlated with etching time.

FIG. 13, in which the peak-to-peak parameter is reported as the ordinates and the etching-time expressed in minutes is reported as the abscissas, shows the results of an AES analysis of the coating obtained according to the present example. More particularly, the analysis can be appreciated of the coating at the point corresponding to the brass/steel interface, for an etching-time of about 27 minutes, that is at 2 μm depth.

The present invention has been disclosed with particular reference to some of its preferred embodiments but it is to be understood that modifications and changes can be introduced by those who are skilled in the art without departing from its true spirit and scope.

We claim:

1. A tartrate-containing alloy bath for electroplating brass on steel wires, which are particularly designed for the production of radial tires, said bath being characterized in that it contains:

tartrate ion: 0.8–1.5M
copper ion: 0.3–0.6M
zinc ion: 0.1–0.3M
alkaline hydroxide: 1.5–3M
with a Cu/Zn ratio of 1.5–3.5 and a density at 20° C. of 1.10–1.3 g/cm$^3$.

2. A bath according to claim 1, said bath further containing:
ammonium chloride: 0.05–0.1M
ammonium nitrate: 0.05–0.1M.

3. A bath according to claim 2 wherein said alkaline hydroxide is caustic soda.

4. A bath according to claim 3, said bath containing:
tartrate ion: 1M
copper ion: 0.4M
zinc ion: 0.2M
caustic soda: 2M
ammonium chloride: 0.05M
ammonium nitrate: 0.05M
with a Cu/Zn ratio of 2 and a density of 1.175 g/cm$^3$ at 20° C.

5. A bath according to claim 3, said bath containing:
tartrate ion: 1M
copper ion: 0.4M
zinc ion: 0.15M
caustic soda: 2.5M
ammonium chloride: 0.05M
ammonium nitrate: 0.05M
with a Cu/Zn ratio of 2.67 and a density of 1.212 g/cm$^3$ at 20°.

6. A bath according to claim 3, said bath containing:
tartrate ion: 1M
copper ion: 0.4M
zinc ion: 0.2M
caustic soda: 2.5M
ammonium chloride: 0.05M
ammonium nitrate: 0.05M
with a Cu/Zn ratio of 2 and a density of 1.204 g/cm$^3$ at 20° C.

7. A bath according to claim 3, said bath containing:
tartrate ion: 1M
copper ion: 0.4M
zinc ion: 0.25M
caustic soda: 3M
ammonium chloride: 0.05M
ammonium nitrate: 0.05M
with a Cu/Zn ratio of 1.6 and a density of 1.222 g/cm$^3$ at 20° C.

8. A bath according to claim 2 wherein said alkaline hydroxide is potash.

9. A bath according to claim 1 wherein said alkaline hydroxide is caustic soda (NaOH).

10. A bath according to claim 9, said bath containing:
tartrate ion: 1.46M
copper ion: 0.49M
zinc ion: 0.25M
caustic soda: 3M
with a Cu/Zn ratio of 1.96 and a density of 1.259 g/cm$^3$ at 20° C.

11. A bath according to claim 1 wherein said alkaline hydroxide is potash (KOH).

12. A method for the employment of a tartrate-containing alloy bath according to any one of claims 1 to 11 for the continuous production of brass-coated steel wires, in which steel wires electroplated within said tartrate bath at a temperature of 25°–50° C. and with current densities of 5–40 A/dm$^2$.

13. A procedure for continuously brass coating steel wires or cords, said procedure comprising the electroplating of brass at a temperature of 25°–50° C. and with current densities of 5–40 A/dm$^2$ within a tartrate-containing alloy bath according to claim 1.

14. A procedure according to claim 13, wherein said bath contains in addition:
ammonium chloride: 0.05–0.1M
ammonium nitrate: 0.05–0.1M.

15. A procedure according to claim 14, wherein said alkaline hydroxide is caustic soda.

16. A procedure according to claim 15 wherein said bath contains:
tartrate ion: 1M
copper ion: 0.4M
zinc ion: 0.15–0.25M
caustic soda: 2–3M
ammonium chloride: 0.05M
ammonium nitrate: 0.05M
with a Cu/Zn ratio between 1.6 and 2.67, and a density between 1.175 and 1.222 g/cm$^3$ at 20° C.

17. A procedure according to claim 13, wherein said alkaline hydroxide is caustic soda (NaOH).

18. A procedure according to claim 17 wherein said bath contains:
tartrate ion: 1.46M
copper ion: 0.49M
zinc ion: 0.25M
caustic soda: 3M
with a Cu/Zn ratio of 1.96 and a density of 1.259 g/cm$^3$ at 20° C.

* * * * *